United States Patent [19]

Miller et al.

[11] Patent Number: 4,842,661

[45] Date of Patent: Jun. 27, 1989

[54] METHOD AND APPARATUS FOR BINDING EDGES OF WOVEN, NON WOVEN AND KNITTED ARTICLES

[75] Inventors: Acie B. Miller; Ralph H. Simpson, Jr., both of Roaring River; Jimmy W. Luffman, Wilkesboro, all of N.C.

[73] Assignee: Golden Needles Knitting & Glove Co., Inc., Wilkesboro, N.C.

[21] Appl. No.: 168,359

[22] Filed: Mar. 15, 1988

Related U.S. Application Data

[62] Division of Ser. No. 14,948, Feb. 17, 1987, Pat. No. 4,755,242.

[51] Int. Cl.[4] ..... B02C 11/08; B30B 15/34

[52] U.S. Cl. ..... 156/88; 156/308.2; 156/367; 156/538; 156/583.1; 156/499; 66/147

[58] Field of Search ..... 156/88, 583.2, 583.1, 156/538, 308.2, 358, 359, 566, 499, 367; 221/150 A, 153; 193/32, 35 G; 414/328; 100/93 P, 215, 218; 28/165, 168, 170, 171; 66/147

[56] References Cited

U.S. PATENT DOCUMENTS

| | | | |
|---|---|---|---|
| 2,578,889 | 12/1951 | Kennedy . | |
| 2,969,580 | 1/1961 | Wyner | 28/168 |
| 3,015,223 | 1/1962 | Moore . | |
| 3,226,275 | 12/1965 | Kiess . | |
| 3,996,771 | 12/1976 | Routh et al. . | |
| 4,069,090 | 1/1978 | Boyer . | |
| 4,755,242 | 7/1988 | Miller et al. | 156/88 |

*Primary Examiner*—Robert A. Dawson
*Assistant Examiner*—Jeff H. Aftergut
*Attorney, Agent, or Firm*—Spencer & Frank

[57] ABSTRACT

A knitted, woven or non woven article such as a glove for example, having a wrist cuff includes an edge binding which is activatable by the application of heat thereto to prevent unraveling of the cuff edge. The bound edge is defined by first and second yarn ends which are knitted or woven together, wherein the first yarn includes a heat activatable, thermoplastic outer covering and the second yarn is defined by a nonthermoplastic, elastic material. The first and second yarns are knitted or woven in a manner to form crossover points therebetween. The edge binding is subjected to heat in order to melt the thermoplastic outer covering of the first yarn, thereby joining the first and second yarns at the crossover points. The articles may be formed on conventional, automatic knitting machines. The knitted articles are ejected from the machine and are gravity fed into a device which melts the thermoplastic outer covering of the first yarn, and thereby bind the edge of the article. The device includes either a pair of heated plates between which the article edge is clamped or an enclosure into which warmed air is introduced to melt the thermoplastic outer covering of the first yarn.

10 Claims, 6 Drawing Sheets

METHOD AND APPARATUS FOR BINDING EDGES OF WOVEN, NON WOVEN AND KNITTED ARTICLES

RELATED APPLICATIONS

The present application is a division of U.S. patent application Ser. No. 014,948, filed Feb. 17, 1987, now U.S. Pat. No. 4,755,242.

TECHNICAL FIELD

The present invention broadly relates to techniques for manufacturing woven, non woven and knitted textile articles, and deals more particularly with a method and apparatus for binding or "finishing" the edge or selvage of the article so as to prevent the edge from unraveling.

BACKGROUND ART

In connection with woven and knitted articles, it is often necessary to bind the free edges of the article to prevent unraveling thereof. This is particularly important in connection with knitted articles in which one or more yarns are loosely knitted together and can become easily unraveled unless the edges thereof are bound in some manner. For example, knitted gloves typically include a cuff which is knitted integrally with the hand portion of the glove. The upper edge of the cuff must be bound in a manner which prevents unraveling of the glove.

One prior approach to binding the cuff edge involves sewing the cuff edge in a second machine operation following the first machine operation of knitting the glove. This approach to the problem, while quite effective, is expensive in terms of labor and the additional equipment needed to perform the sewing operation.

Another approach to binding the cuff edge involves the use of heat activatable thermoplastic yarns used in the cuff edge which can be melted by the application thereto of heat and thereby bind the cuff edge. The cuff edge used in this construction consists of a single end of yarn having an outer covering of thermoplastic material. The single yarn end is knitted together to form the edge. Upon application of heat to the thermoplastic yarn, bonds are formed at the crossover points of the yarn. In a more recent approach to binding the cuff edge which is described and claimed in U.S. patent application Ser. No. 014,946, filed Feb. 17, 1987, and assigned to the assignee of the present application, the cuff edge is formed by a knitted combination of thermoplastic and nonthermoplastic yarns. Upon application of heat to the cuff edge, the thermoplastic yarn melts and become bonded to the nonthermoplastic yarn. This latter approach is superior to previous techniques for numerous reasons, but, as in prior art constructions, it is necessary to apply heat to the cuff edge at the proper temperature for a preselected duration.

Various types of methods and apparatus are well-known in the art for applying heat to knitted and woven articles for the purpose of "setting" the yarns and melting thermoplastic yarns. In connection with the "finishing" of glove cuff edges employing thermoplastic material, commercially available machines have been employed, such as the Model SH-100 High Speed Finishing Machine manufactured by Shima Seiki of Wakayama, Japan. The Shima Seiki machine is a relatively complicated and expensive, stand-alone unit. It includes a conveyor on which gloves are manually placed after they are knitted on a conventional knitting machine. The conveyor moves the unfinished gloves through a heated area in the machine in order to melt the thermoplastic yarns in the cuff edge. The use of such machines possesses several disadvantages. First, they are stand-alone units, require a substantial amount of space, are complicated and therefore subject to breakdown and are quite expensive. Secondly, these machines cannot automatically receive gloves which are knitted serially by the glove knitting machine. It is therefore necessary for an operator to accumulate and transfer gloves from the knitting machine to the area of the finishing machine, and thereafter hand feed the finishing machine. This, of course, is costly in terms of labor.

The present invention is intended to overcome each of the shortcomings of the prior art mentioned above.

SUMMARY OF THE INVENTION

In accordance with one aspect of the present invention, apparatus is provided for finishing the edges of woven, non woven or knitted articles of the type employing a thermoplastic yarn and which can be used in combination with a conventional automatic weaving or knitting machine of the type having means for weaving or knitting an article and ejection area from which the knitted, woven or non woven articles are ejected. Broadly, apparatus is provided for melting thermoplastic material employed to finish the edge of a woven, non woven or knitted article and is particularly adapted for use with the machine for automatically forming the article from textiles as by knitting or weaving, wherein the machine is of the type having an area from which the article is ejected. The apparatus includes means disposed beneath the ejection area for receiving and temporarily holding the article after the article is ejected from the machine. In one embodiment of the apparatus, the means for temporarily holding the article comprises structure below the ejection area mounted on the machine which slidably receives, and temporarily supports the article. The structure includes a swingable door which acts as a barrier to engage and temporarily block the gravity influenced, downward travel of the article. Heat is applied to the article edge by a pair of relatively reciprocable, heated plates which function to clamp the article therebetween while the article is being held. At least one of the clamping plates, and the barrier door are operated by motor members whose operation are controlled in timed relationship to each other by the programmable controller employed to control the operation of the machine.

Another form of the apparatus includes a chamber or housing disposed below the ejection area of the machine for temporarily enclosing the knitted article after the article is ejected from the machine. The enclosure includes a first opening in the upper portion thereof through which the article may fall by the influence of gravity into the enclosure. Means are provided for heating the air within the enclosure, wherein the temperature of the heated air within the enclosure is sufficient to at least partially melt the thermoplastic yarn and thereby finish the article edge. The enclosure includes a second opening in a lower portion thereof through which the finished article may be discharged from the enclosure under the influence of gravity. The opening in the lower portion of the enclosure is selectively closed by a discharge door which is controlled by a motor operated by a controller which also controls the operations of the machine. The controller likewise selectively activates a hot air blower which introduces hot air into the closure for the requisite period of time required to melt the thermoplastic yarn. The finishing apparatus according to the present invention is exceptionally simple and therefore not only inexpensive but highly reliable. Moreover, the finishing apparatus of the present invention is readily adapted for use with existing knitting and weaving machines and avoids the need for hand feeding articles thereto.

According to another aspect of the invention, a method is provided for finishing an edge of an article which is automatically woven or knitted by a knitting or weaving machine, of the type which ejects the article from an ejection area on the machine, and wherein the edge of the article includes a heat meltable thermoplastic material which binds the edge when the thermoplastic material is melted. The method comprises steps of delivering the article from the ejection area of the machine to a first station using the influence of gravity, holding the article beneath the ejection area, subjecting the article to heat sufficient in temperature to melt the thermoplastic material while the article is being held at the first station, releasing the article after it is subjected to heat and delivering the article from the first station to a second station using the influence of gravity. The article is held at the first station beneath the ejection area by introducing a barrier into the path of travel of the article, and the article is released for delivery to the second station by removing the barrier. The article is subjected to heat preferably by clamping the article between a pair of heated plates.

It is therefore a primary object of the invention to provide a method and apparatus for binding edges of woven, non woven and knitted articles which is readily adapted for use with existing machines for weaving, knitting or forming such articles.

Another object of the invention is to provide apparatus as described above which is exceptionally simple in design and therefore is highly reliable and cost effective to manufacture.

A further object of the present invention is to provide a method and apparatus as described above in which unfinished knitted, woven or non woven articles are automatically fed thereto to the apparatus without the need for human intervention and handling of the articles.

These, and further objects and features of the present invention will be made clear or will become apparent during the course of the following description of the preferred embodiment of the present invention.

BRIEF DESCRIPTION OF THE DRAWINGS

In the drawings, which form an integral part of the specification and are to be read in conjunction therewith, and in which like reference numerals are employed to designate identical components in the various views.

DESCRIPTION OF THE PREFERRED EMBODIMENTS

Figure 1:
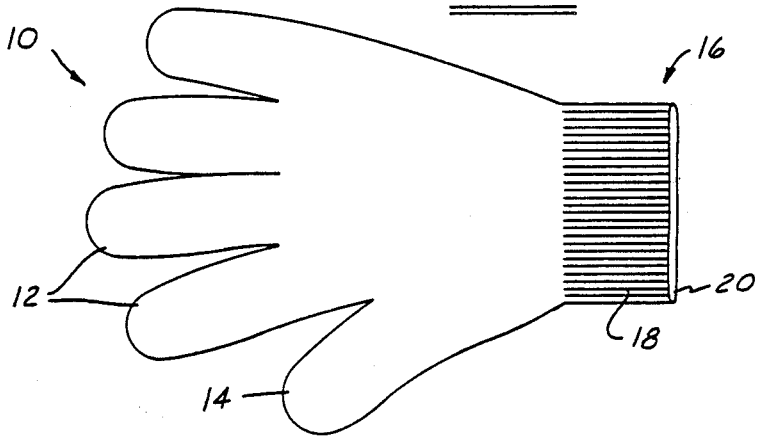
FIG. 1 is a plan view of a glove having a cuff provided with an edge binding that can be finished using the method and apparatus of the present invention.

The present invention relates to apparatus useful in finishing the edge of a woven, non woven or knitted article, such as the knitted glove generally indicated by the numeral 10 in FIG. 1. The glove 10 includes knitted fingers 12, a knitted thumb 14 and a cuff 16 which is knitted integrally with the hand of the glove 10. The cuff 16 typically includes elastic ribs 18 which allow expansion of the cuff 16 to allow a user to insert his or her hand into the glove 10. The cuff 18 includes an outer edge 20 which is bound to prevent unraveling of the cuff 18. The glove 10 may be knitted or woven of any of various yarns such as cotton, acrylic, kevlar, etc. The cuff 16 is typically woven or knitted of the same material forming the hand of the glove, but preferably includes an elastic yarn to provide the cuff 16 with an elastic characteristic so that the cuff 16 fits snugly around the wrist of the wearer. In the case of the knitted glove 10, the elastic yarn is effectively introduced into alternating courses of the knitted yarn.

Figure 2:
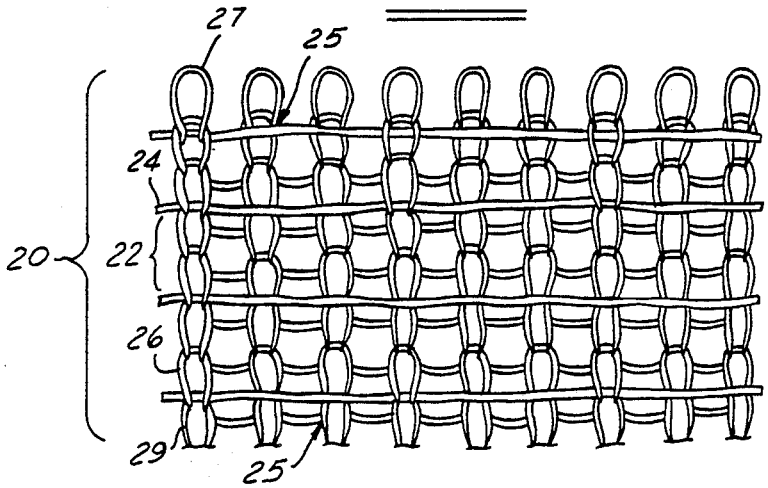
FIG. 2 is an enlarged, fragmentary view of the edge binding shown in FIG. 1, prior to the activation of the thermoplastic yarn.

The details of the edge binding 20 are depicted in FIG. 2 wherein only the last several courses of the cuff 18 are shown. It should be noted here that the edge binding 20 may consist of more or less than the specific number of courses shown in the drawings and that the embodiment illustrated in FIG. 2 is merely exemplary. Each course of the edge binding 20 comprises two rows 22 of a first yarn end 26 formed into a weft knit, and a second yarn end 24. The second yarn end 24 is effectively woven through alternating groups of columns of the knitted chains defined by the first yarn end 26. Each column of chains defined by the first yarn end 26 is terminated in free loops 27. The yarn 24 is associated with the chains of the first yarn 26 so as to form points of intersection or crossover points 25 which will be discussed later in more detail.

Figure 3:
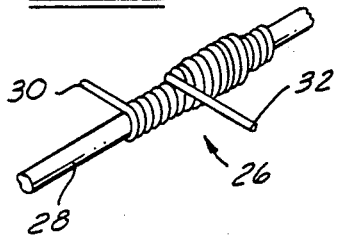
FIG. 3 is a fragmentary, perspective view of one yarn end employed in the edge binding which includes a thermoplastic outer covering.

The yarn end 26 is depicted in more detail in FIG. 3. Yarn end 26 includes an inner core 28 which is preferably of an elastic material such as rubber. The rubber core 28 is wrapped in one circumferential direction with a helically wound fiber or filament 30 such as acrylic. The yarn 26 further includes an outer covering defined by a fiber or filament 32 of a thermoplastic material which is helically wrapped around the inner core, in the circumferential direction opposite that of the inner covering 30. The outer covering 32 may comprise any of various well-known thermoplastic materials, such as polyethylene for example, which preferably has a melting point above that normally encountered during ordinary washing of the knitted or woven article but sufficiently low to facilitate melting of the thermoplastic material without the application of excessive heat. For example, a melting point of between 200 and 250 degrees Fahrenheit would be suitable for many applications.

Figure 4:
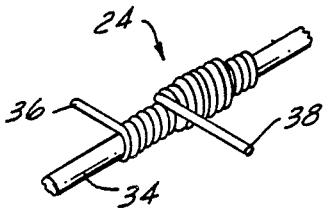
FIG. 4 is a fragmentary, perspective view of another yarn end employed in the edge binding.

The details of the construction of the second yarn end 24 are shown in FIG. 4. The second yarn 24 comprises a core 34 of elastic material such as rubber which is helically wrapped with an inner covering 36 defined by a fiber or filament such as polyester. The yarn 24 further includes an outer covering 38 defined by a filament or fiber of material such as polyester which is helically wrapped in the opposite circumferential direction of the wrapping of the inner covering 36. One yarn suitable for use as the yarn end 24 is available from MacField Texturing Company of Madison, N.C. which is identified by the manufacturers style No. 5439. This yarn has a 50 gage rubber core with the inner and outer coverings 36, 38 respectively comprising 70 denier polyester. The yarn has 315 percent elongation and yields 2.345 yards per pound.

It is important that the diameter of the inner core 28 of the first yarn end 26 be relatively substantial in comparison to the diameter of the inner core 34 of the second yarn end 24. For example, where the inner core 34 of the yarn end 24 is 50 gage, the inner core 28 of the yarn end 26 should be much less than 100, for example about 50 gage, although 85 gage has provided acceptable results. One yarn suitable for use as the first yarn end 26 is available from Supreme Elastic Corporation of Hickory, N.C. and is identified by the manufacturer's Style Number FLOR-M-2000. This yarn has an 85 gage rubber core which constitutes 13.8% of the yarn by weight, an inner wrapped cover of 18/2 Acrylic which constitutes 72.5% of the yarn by weight and an outer wrapped cover of FLOR-M-2000 thermoplastic which constitutes 13.8% of the yarn by weight. The yarn possesses a relaxed yield of 1482 yards per pound and an elongation of 240%.

Although not specifically shown in FIG. 2, the construction of the cuff 16 below the binding edge 20 comprises weft knitted chains of a third yarn end 29 (FIG. 5) interspersed with the elastic yarn end 24. The third yarn end 29 is identical to that which makes up the palm, fingers and thumb of the glove 10. In other words, the lower part of the cuff has a construction identical to that depicted in FIG. 2 except that the rough knitted chains comprise a conventional yarn rather than a thermoplastic covered yarn.

The foregoing construction of a textile edge 20 is merely illustrative of one type which can be finished using the method and apparatus of the present invention described hereinbelow.

Figure 5:
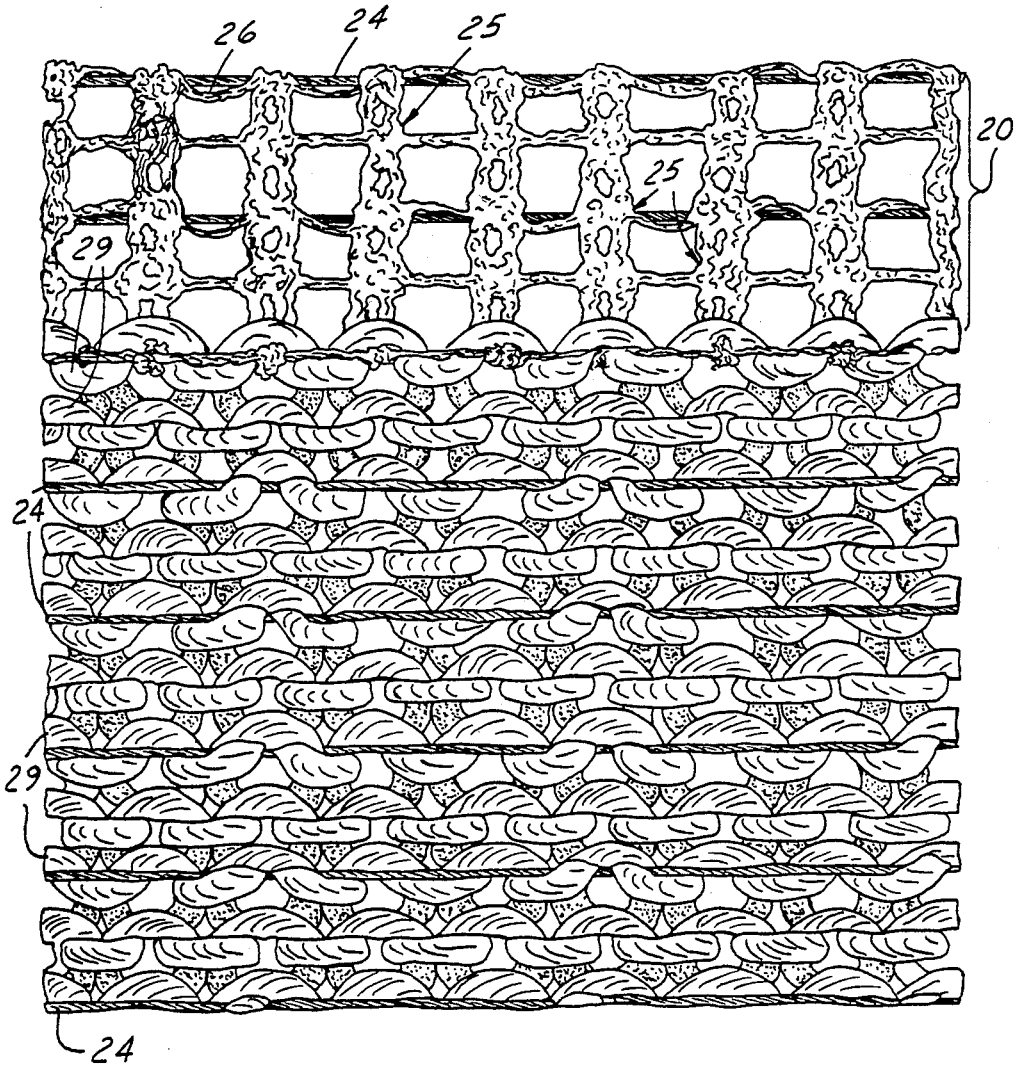
FIG. 5 is a view similar to FIG. 2 but depicting the edge binding after the thermoplastic yarn has been activated.

FIG. 5 depicts an enlarged portion of the cuff 16, and more particularly the binding edge 20 as well as a portion of the cuff 16 below the binding edge 20, after the application of heat to the cuff 16 using the latter described apparatus of the present invention. The application of heat to the binding edge 20 results in the melting of the thermoplastic outer covering 32 of the first yarn 26. This melting or "activation" of the thermoplastic outer covering can be accomplished by any of various known techniques including the use of a heated medium such as steam or air, or the application of microwave energy. In any event, as can be seen in FIG. 5, the melting of the outer thermoplastic covering 32 results in the formation of thermoplastic bonds between the first and second yarn ends 24, 26 at the crossover points 25. The second yarn 24 functions to hold the thermoplastic bonds in place. Moreover, because the second yarn 24 is elastic, the thermoplastic bonds are allowed to stretch somewhat along with the elongation of the second yarn 24 when the binding edge 20 is stretched, thereby preventing breakage of these bonds. Additionally, the diameter of the inner core 28 of the first yarn end 26 is sufficient such that such core 28, in combination with the second yarn end 24 provides a matrix to hold and support the melted thermoplastic material. The above mentioned cooperation effectively prevents the first and second yarn ends 24 and 26 from separating each other which would otherwise result in unraveling of the cuff 18.

Figure 6:
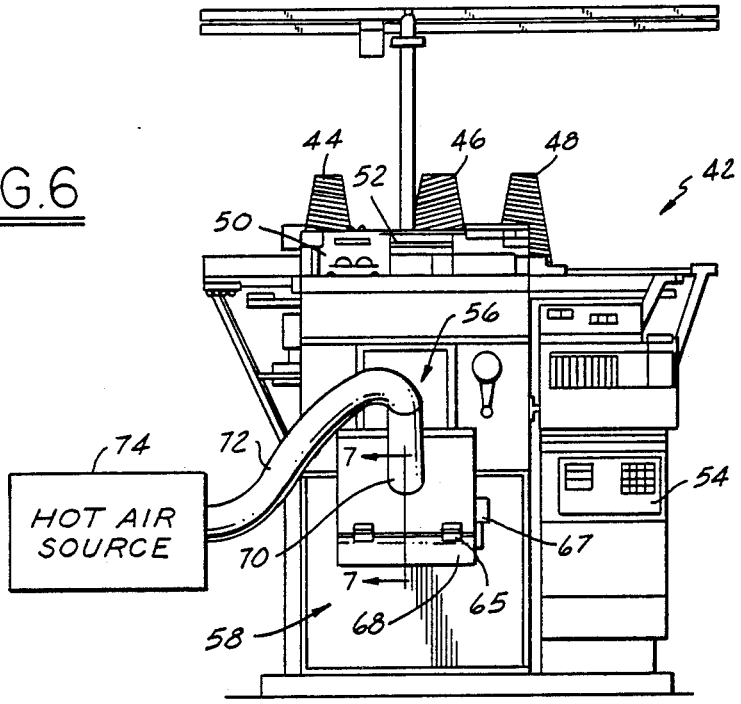
FIG. 6 is a front elevational view of a machine for knitting the glove shown in FIG. 1 and which includes apparatus for activating the thermoplastic yarn of the edge binding which forms one embodiment of the present invention.

The knitted glove 10 described above can be manufactured using a machine of the type depicted in FIG. 6. As shown in FIG. 6, a glove knitting machine generally indicated by the numeral 42 automatically knits individual gloves using yarn ends supplied from yarn spools 44-48 which respectively comprise the yarns 24, 26 and 29 discussed above. The yarns from the spools 44-48 are fed to a needle bed (not shown) by means of a yarn feeding carriage 50 mounted for reciprocal movement on rails 52. The mechanisms of the machine 42 are automatically controlled by a computerized controller 54. The machine as thus far described may comprise, by way of example, a model SH-100 high speed finishing machine manufactured by Shima Seiki of Wakayama, Japan.

Upon completion of a knitting cycle, the finished glove is ejected from the front of the machine at an ejection area 56. The machine 42 includes apparatus now to be described which activates (melts the thermoplastic yarn of the edge 20), thereby "finishing" such edge. One form of the apparatus of the present invention shown in FIGS. 6 and 7 includes a housing or chamber 58 which is mounted on the face of the machine 42, immediately below the ejection area 56. The housing 58 includes an inclined top wall 60, an inclined bottom wall 62 and side walls 61. The upper end of the housing 58 includes an opening 66 thereon immediately below the ejection are 56 which is position so as to receive a glove 10 as it is ejected from the machine 42. The bottom wall 62 is inclined from vertical at approximately a 45 degree angle. The lower end of the housing 58 is selectively closed by a door 68 which is pivotally connected to the top wall 60 by means of hinges 65. In its closed position, shown in full lines in FIG. 7, the door 68 preferably forms a 30 degree angle with respect to the bottom wall 62, thereby functioning to wedge the outer end of the fingers 12 of the glove 10; in this manner the glove 10 is held in a precise, preselected position within the housing 58. The opening and closing of the door 68 is controlled by a conventional pneumatic or electrically operated motor member 67 which is in turn operated by the controller 54.

Figure 7:
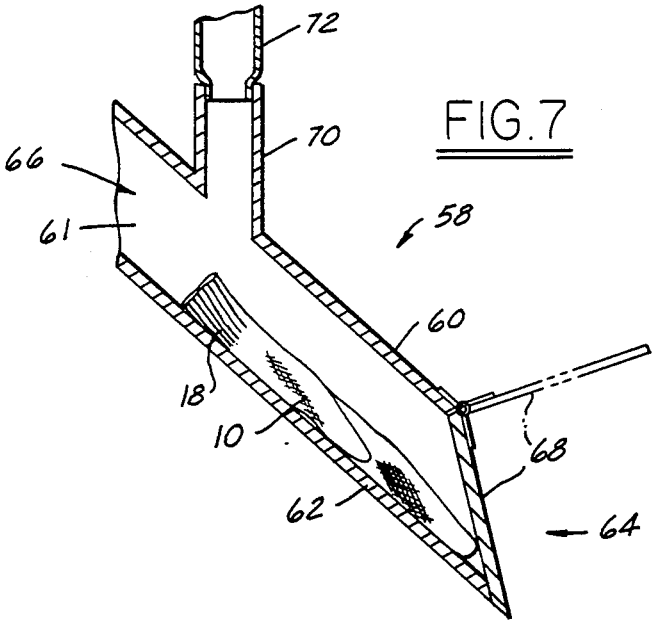
FIG. 7 is a sectional view taken along the line 7—7 in FIG. 6, the open position of the chamber door being indicated in the phantom.
Figure 8:
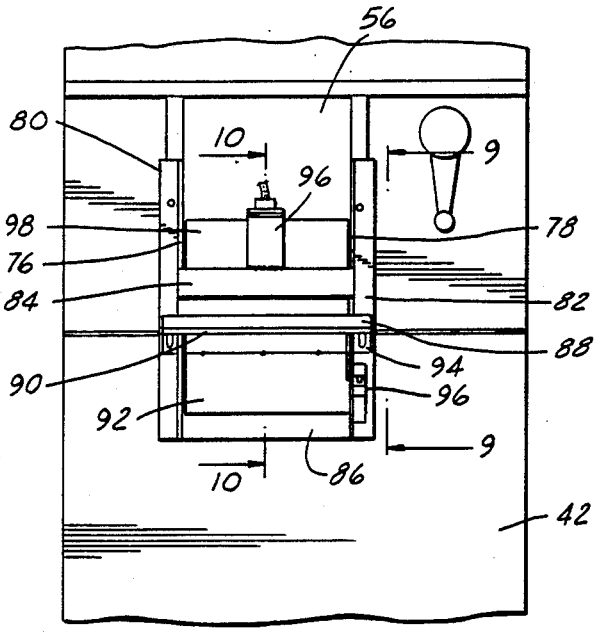
FIG. 8 is a fragmentary front view of the machine shown in FIG. 6, but depicted with another form of apparatus for activating the thermoplastic yarn which forms the preferred embodiment of the present invention.
Figure 9:
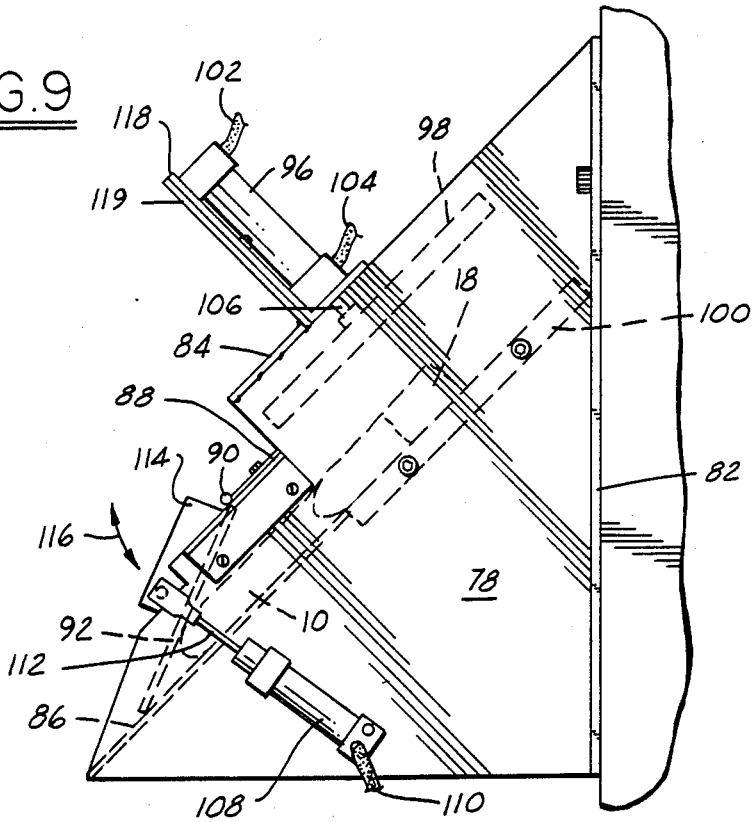
FIG. 9 is a sectional view taken along the line 9—9 in FIG. 8.
Figure 10:
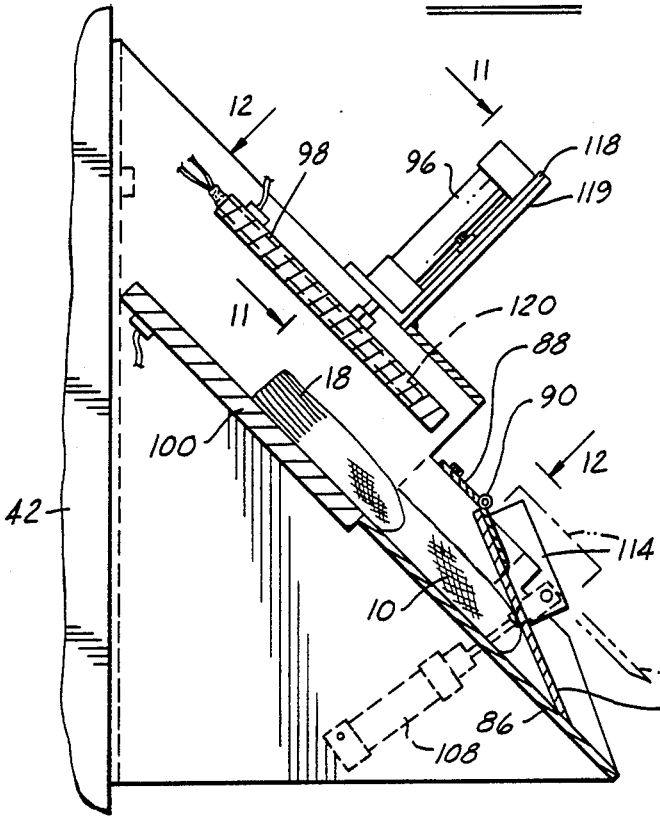
FIG. 10 is a sectional view taken along the line 10—10 in FIG. 8.
Figure 11:
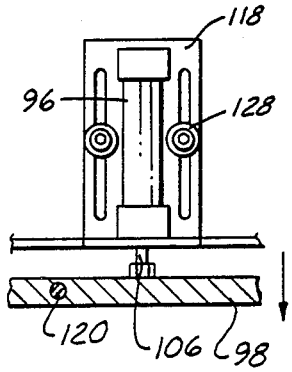
FIG. 11 is a sectional view taken along the line 11—11 in FIG. 10.
Figure 12:
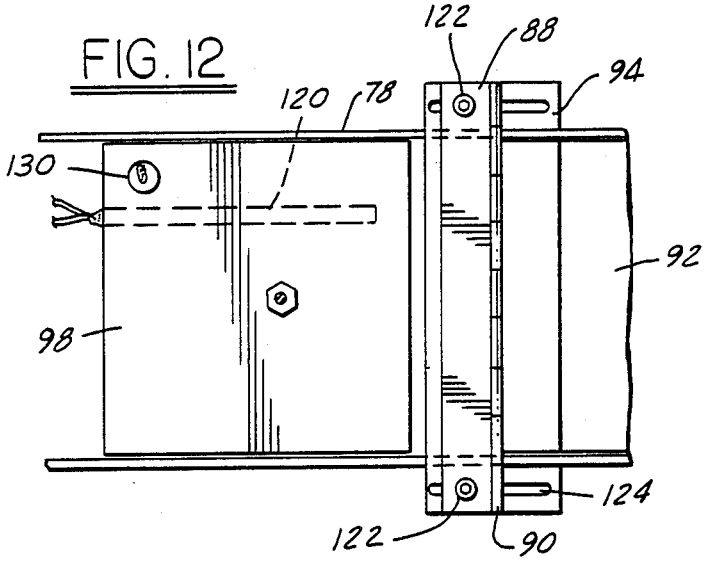
FIG. 12 is a sectional view taken along the line 12—12 in FIG. 10.

The top wall 60 of the housing 58 includes a tubular stack 70 through which hot air may be introduced into the interior of the housing 58. The tubular stack 70 is connected by means of a conduit 72 to a conventional source of hot air 74. The hot air source 74 typically includes a heating element for heating the air and an electrically driven blower for forcing the heated air through the conduits 72 into the interior of the housing 58. As best seen in FIG. 7, the tubular stack 70 is positioned immediately above the cuff 18 of the glove 10 so that hot air will impinge upon the binding edge 20.

In operation, after a glove 10 has been knitted by the machine 42, the knitted glove is ejected, fingers 12 first, from the ejection area 56 and the glove 10 slides under the influence of gravity through the opening 66 into the housing 58 and comes to rest with the fingers 12 wedged between the door 68 and the bottom wall 62. The ejection of the glove from the machine 42 is sensed and in response thereto, the controller 54 activates the hot air source 74 so as to introduce hot air through the conduit 72 into the housing 58 for a preselected length of time sufficient to assure that the thermoplastic yarn in the edge binding 20 is properly melted. As mentioned above, the temperature of hot air within the housing 58 is at least as hot as the melting point of the thermoplastic material, e.g., between 200 and 250 degrees Fahrenheit. During the period that hot air is introduced to the housing 58, the next glove is being automatically knit on the machine 42. After hot air has been introduced into the housing 58 for the requisite period of time, the controller 54 disables the hot air source 74 and activates the motor member 67 to move the door 68 to its open position, whereupon the glove 10 slides, by influence of gravity, out through the bottom opening 64 in the housing 58. The finished gloves discharged from the housing 58 may be accumulated in any suitable receptacle (not shown). After the glove is ejected from the housing 58, the controller 54 activates the motor member 67 to close the door 68, thereby readying the housing 58 to receive the next glove ejected from the machine 42.

Reference is now made to FIGS. 8–12 in which another form of the apparatus for finishing the edge of a woven, non woven or knitted article is depicted, wherein the edge is at least partially defined by a thermoplastic yarn. This alternate form of the apparatus, which comprises the preferred embodiment of the invention, is adapted to be mounted on the face of the knitting machine 42, immediately beneath the ejection area 56. The apparatus includes a pair of side walls 76, 78 which extend forwardly from the face of the machine 42. The side walls 76, 78 include respective flanges 80, 82 which are secured, as by bolts or the like, to the front of the machine. The side walls, 76, 78 are structurally connected by a cross piece 84 and an inclined bottom wall 86.

A selectively shiftable barrier in the form of a door 92 is mounted for pivotal movement by hinge 90 on a mounting plate 88. The mounting plate 88 extends transversely between side walls 76, 78 and is shiftably mounted by screws 122 on mounting brackets 94 which are in turn respectively secured to the outer sides of side wall 76 and 78. The mounting brackets 94 include elongate slots 124 therein to permit adjustment of the position of the mounting plate 88, and thus the longitudinal position of the door 92, for reasons which will become later apparent.

Mounted on one side of the door 92 is a connecting bracket 114. A pneumatic cylinder 108 is mounted on side wall 78 and is controlled by a electrically actuated, pneumatic control line 110. Cylinder 108 has its output shaft 112 pivotally mounted to the connecting plate 114 so that upon reciprocation of the shaft 112, the door 92 is pivoted about hinge 90 between an open and closed position. The structure thus far described defines a means for temporarily holding an article, such as a glove 10 which is ejected from the machine 42 from the ejection area 56.

Means for activating the thermoplastic yarn of the article 10 comprises, in this particular embodiment, a pair of clamping members in the nature of heated plates 98 and 100. The lower plate 100 is secured in an inclined position by screws or the like which extend through the side walls 76, 78. The upper surface of plate 100 is essentially coplanar with the bottom wall 86 and effectively forms an extension of the bottom wall 88 so as to support the article 10.

The upper plate 98 is secured to the output shaft 106 of a second pneumatic cylinder 96 which is controlled by a pair of electrically actuated, pneumatic lines 102, 104. The cylinder 96 is secured to an L-shaped bracket 118 which overlies a mounting plate 119 that in turn is secured as by welding to the cross piece 84. The mounting plate 119 and bracket 118 include aligned, elongate slots 126 through which screws 128 extend so that the assembly of the cylinder 96 and bracket 118 is slidable in position relative to the mounting plate 119. This sliding movement permits adjustment of the position of the upper plate 98 relative to the lower plate 100.

The platen-like plates 98, 100 are preferably coated with a non stick layer of material such as Teflon to prevent adherence thereof to the article 10, and particularly the melted thermoplastic forming a portion of the edge thereof to be bound. The plates 98, 100 which may comprise aluminum, are heated by any conventional means such as a cartridge-type heating element 120 manufactured by Chromalox of Pittsburgh, Pa. and identified by the manufacturer's model no. CIR-2051.

Figure 13:
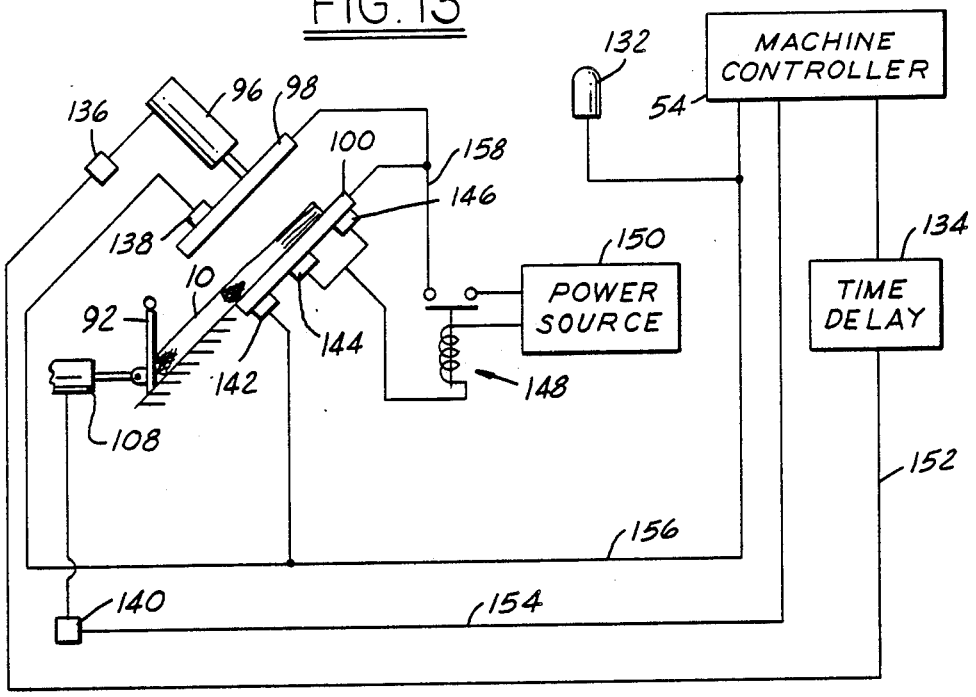
FIG. 13 is a combined block and diagrammatic view of the control circuit for the apparatus shown in FIGS. 8–12.

Reference is now made to FIG. 13 which depicts the control system for operating the apparatus described above with reference to FIGS. 8–12. Control signals are produced by the programmed controller 54 which forms an integral part of the machine 42. Through the use of conventional means such as micro switches, the controller 54 senses the points in time when a glove being knitted is in specific stages of completion. For example, a micro switch (not shown) mounted on the machine 42 so as to be tripped by the knitting mechanism when a glove reaches a certain stage of completion, issues a signal which is delivered to a time delay 134. The time delay 134 is responsive to this signal for generating on line 152, a control signal for a preselected length of time. The signal is issued by the controller 54 to the time delay 134 for example when the machine 42 starts knitting the next glove in the beginning of the next knitting cycle.

In a similar manner, another micro switch (not shown) actuated by operation of the machine 42 results in the issuance of a signal on line 154 when the machine 42 commences knitting of the thumb of next glove. The signal on line 154 actuates a switch 140 which in turn actuates the cylinder 108. From the foregoing then, it can be appreciated that the signal is issued by the controller 54 on lines 152 and 154 respectively control the operation of the movement of the upper plate 98 and the position of the door 92.

Heat responsive switches 138, 132 are respectively mounted on plates 98, 100 to sense the temperature of these plates. When the temperature of plates 98, 100 as respectively sensed by the heat sensor switches 138, 142 drops below a preselected value, for example 210° F., a signal is issued on line 156 which is delivered to the machine controller 54 as well as to a lamp 132 which may be mounted at any conspicuous location on the machine 42 so as to alert the operator of the low temperature condition. The machine controller 54 is programmed to terminate the operation of the machine 42 is response to the signal on line 156.

The heating elements 120 of the plates 98, 100 are coupled via line 158 to an electrical power source 150 via a relay 148. The contacts of the relay 148 which couple the power source 150 with the heating elements 120 are closed as a result of the energization of the coil of the relay 148. The relay coil is coupled between the power source 150 and a pair of heat responsive electrical switches 144, 146 which are mounted on and responsive to the temperature of the lower plate 100. The heat responsive switch 144 is normally closed when the sensed temperature of the lower plate 100 is within a preselected range, e.g. 250°–290° F. The coil of the relay 148 is also connected with a heat responsive switch 146 in the nature of a thermal fuse which is normally closed but which opens when the temperature of the lower plate 100 exceeds a higher temperature level, e.g. 440° F.

Turning now to the operation of the apparatus shown in FIGS. 8–13, let it first be assumed that the door 92 is closed so as to engage the bottom wall 86 and thus form a barrier to the travel of an article 10 through door 92. Let it also be assumed that the upper plate 98 is in a raised, stand-by position and that a just-knitted glove has been issued from the ejection area 56 of the machine 42. The glove 10 falls by the influence of gravity from the opening 56 downwardly between the opening presented between the upper and lower plates 198, 100 and thereafter slides downwardly on the lower plate 100 and the bottom wall 86. The door 92 engages the glove fingers and thus limits the downward travel of the glove 10. The longitudinal position of the door 92, along the path of travel of the glove 10 is adjusted such that the cuff 18 of the glove 10 is positioned between the upper and lower plates 98, 100.

When the machine 42 commences knitting the next glove in the beginning of the next knitting cycle, a signal is issued by the machine controller to the time delay 134. The time delay 134 is a conventional electronic device which includes means for manually adjusting the length of time which a signal remains on line 152. The signal on line 152 results in the actuation of cylinder 96 which in turn displaces the upper plate 98 toward the lower plate 100 to clamp the cuff 18 therebetween. The duration for which the plates 98, 100 remain clamped against the cuff 18 is determined by the duration of the signal on line 52, which in turn is determined by the setting of the time delay 134. The heat from the plates 98, 100, is, of course, sufficient to reliably and thoroughly melt the thermoplastic material forming a part of the cuff 18 so as to finish the edge of the cuff. When the time delay 134 times out, cylinder 96 retracts plate 98. A preselected time after the plate 98 has been retracted, the machine controller 54 issues a signal on line 154 which results in the actuation of cylinder 108 which opens the door 92. Upon opening of the door 92, the glove 10 is allowed to slide from its position or station within the finishing apparatus, downwardly along the bottom wall 88 to a second station or area (not shown) where the finished gloves may be collected. Thereafter, the controller 54 issues another signal on line 154 which results in the closing of the door 92, thereby readying the apparatus for the receipt of the next glove issued by the machine 42.

The switches 138, 142 function as fail safe circuits which cause the machine controller 54 to terminate operation of the machine if a malfunction occurs in which the temperature of the plates 98, 100 drop below a preselected temperature which would be ineffective in melting the thermoplastic material.

Switch 144 is normally closed, thereby energizing the coil of the relay 148 to hold power on the heating elements 120, unless the sense temperature exceeds a preselected upper value, which is regarded as too high or unsafe. Should this upper temperature level be exceeded, the switch 144 is activated to an open position, thereby removing power from the heating elements 120 and the switch 144 remains open until the plate temperature cools to a lower value.

As previously mentioned, the extended working position of the upper plate 98 can be adjusted to accommodate articles of various thickness by adjusting the position of the mounting bracket 118.

From the foregoing, it is apparent that the novel method and edge finishing apparatus described above not only provides for the reliable accomplishment of the objects of the invention but does so in a particularly economical and efficient manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalence thereof fairly within the scope of the invention.

What is claimed is:

1. For use with an automatic knitting or weaving machine of the type having means for knitting or weaving an article and an ejection area from which said article is ejected therefrom, said article having an edge which includes thermoplastic material, apparatus for melting said thermoplastic material to finish said edge, comprising:

enclosure means disposed below said ejection area for temporarily enclosing and retaining said article after said article is ejected from said ejection area, said enclosure means including a first opening in an upper portion thereof through which said article may fall under gravitational influence into said enclosure means, said enclosure means having an outlet through which said article may be discharged from said enclosure means, said enclosure means having air therein said enclosure means includes an inclined bottom wall for supporting said article; and, means for heating the air within said enclosure means, the air in said enclosure means being heated a sufficient amount to at least partially melt said thermoplastic material while said article is retained in said enclosure means and thereby finish said edge.

2. The apparatus of claim 1, wherein said enclosure means outlet is in a lower portion thereof through which said knitted article is discharged under the influence of gravity.

3. The apparatus of claim 2, including:

closure means shiftably mounted on said enclosure means for selectively closing said second opening; and a controller for controlling operation of said closure means in timed relationship.

4. The apparatus of claim 2, including a closure shiftably mounted on said enclosure means and covering said second opening, said enclosure means including a bottom wall, portions of said bottom wall and said closure opposing each other and forming an acute angle, portions of said knitted article being receivable in wedged relationship between said opposing portions, whereby said knitted article is retained in a fixed position within said enclosure means.

5. The apparatus of claim 2, wherein said enclosure means includes a top wall, a bottom wall and side walls, and wherein said enclosure means includes a door pivotally mounted on said top wall.

6. The apparatus of claim 1, wherein said enclosure means includes an inlet therein and said heating means is coupled with said inlet.

7. The apparatus of claim 1, wherein said heating means includes means for forcing heated air into said enclosure means through an inlet.

8. A method of finishing an edge of an article which is automatically woven or knitted by a knitting or weaving machine, of a type which ejects the article from an ejection area of the machine, and wherein the edge of the article includes a heat meltable thermoplastic material which binds the edge when the thermoplastic material is melted, said method comprising the steps of:

(A) delivering said article from said ejection area of said machine to a first station beneath said ejection area using gravitational influence said first station including an inclined bottom wall for supporting said article;

(B) holding said article at said first station;

(C) melting said thermoplastic material by applying heated air to said article while said article is held in step (B);

(D) releasing said article after step (C) is performed; and (E) delivering said article from said first station to a second station using the influence of gravity after step (D) is performed.

9. The method of claim 8, including the steps of slidably supporting said article and guiding said article from said ejection area to said first station.

10. The method of claim 8, wherein a path of travel of said article is defined from said ejection area to said first and second stations, respectively, and wherein step (B) is performed by moving a barrier into the path of travel of said article and step (D) is performed by moving said barrier out of the path of travel of said article.

* * * * *